US007416160B2

(12) United States Patent
Cies

(10) Patent No.: US 7,416,160 B2
(45) Date of Patent: Aug. 26, 2008

(54) COUPLING ASSEMBLY FOR RELEASABLY CONNECTING A TRASH CONTAINER WITH A FIXED OBJECT

(76) Inventor: Edwin L. Cies, 1386 Preserve Cir., Golden, CO (US) 80401

( * ) Notice: Subject to any disclaimer, the term of this patent is extended or adjusted under 35 U.S.C. 154(b) by 123 days.

(21) Appl. No.: 11/027,220

(22) Filed: Dec. 29, 2004

(65) Prior Publication Data

US 2006/0138291 A1 Jun. 29, 2006

(51) Int. Cl.
*A47B 96/06* (2006.01)

(52) U.S. Cl. ..... 248/213.2; 248/205.3; 248/225.21; 220/283

(58) Field of Classification Search ..... 248/205.3, 248/213.2, 225.21, 316.8, 201, 312.1, 225.11; 220/283, 481, 482; 232/43.5
See application file for complete search history.

(56) References Cited

U.S. PATENT DOCUMENTS 412,499 A * 10/1889 Hamilton ..... 248/221.11
1,072,022 A * 9/1913 Miller ..... 232/43.5
2,595,752 A * 5/1952 Batts ..... 248/224.8
2,648,495 A * 8/1953 Borst ..... 232/43.5
3,125,212 A * 3/1964 Gerber ..... 224/547
3,181,905 A * 5/1965 Bisbing ..... 292/109
3,207,355 A * 9/1965 Saphier ..... 220/481
3,263,854 A * 8/1966 Powers ..... 232/43.5
3,458,113 A * 7/1969 Swartzbaugh ..... 220/324
3,466,076 A * 9/1969 Bisbing ..... 292/109
3,526,314 A * 9/1970 Trammell, Jr. ..... 224/275
3,698,565 A * 10/1972 Weber ..... 211/87.01
3,892,315 A * 7/1975 Johnson ..... 211/85.19
4,008,872 A * 2/1977 Thompson ..... 248/224.61
4,069,998 A * 1/1978 Rytting ..... 248/476
4,133,507 A * 1/1979 Chervenak ..... 248/223.41
4,457,436 A * 7/1984 Kelley ..... 211/88.01
4,530,482 A * 7/1985 Berinson ..... 248/475.1
4,611,780 A * 9/1986 Robertson ..... 248/477
4,899,971 A * 2/1990 Elkin ..... 248/225.11
5,092,487 A * 3/1992 Richer et al. ..... 220/482
5,383,257 A * 1/1995 Krauss ..... 24/625
5,472,167 A * 12/1995 Shillington et al. ..... 248/552
5,870,969 A * 2/1999 Boyce ..... 119/61.3
6,616,109 B1 * 9/2003 Jarrett et al. ..... 248/201
D484,778 S * 1/2004 French ..... D8/373
6,772,902 B1 * 8/2004 White ..... 220/283

* cited by examiner

*Primary Examiner*—Anita M King
(74) *Attorney, Agent, or Firm*—Dorsey & Whitney LLP

(57) ABSTRACT

The present invention provides for a coupling assembly for releasably connecting a trash container with a fixed object, such as a wall or cabinet. The coupling assembly acts to prevent the trash container from being easily tipped onto its side, while allowing user to easily disconnect the trash container from the fixed object. The coupling apparatus includes a first coupling connected with the fixed object a second coupling member connected with the trash container. The second coupling member includes an extended portion adapted to be received within a pocket on the first coupling member. The coupling assembly can be configured to work with trash containers having different shapes and sizes. The trash container can also include a lid further restrict access to the inside of the trash container. As described below, a latch or clasp can also be used to selectively lock the lid in closed position.

1 Claim, 6 Drawing Sheets

COUPLING ASSEMBLY FOR RELEASABLY CONNECTING A TRASH CONTAINER WITH A FIXED OBJECT

BACKGROUND OF THE INVENTION a. Field of the Invention

This invention relates to trash containers, and more particularly, a coupling apparatus for releasably connecting trash containers with a fixed object, such as a wall or cabinet.

b. Background Art

Trash containers are well known in the art. Many trash containers are adapted for use in a household or office environment for temporary storage of waste and garbage. Based on a regularly scheduled janitorial service or once such a trash container is full, the trash container is typically emptied and its contents transported to a dump or other similar facility. Because these containers are adapted for use in a household or office environment, they are typically configured to hold a relatively small volume of garbage. Many such trash containers are configured with a body having a bottom side adapted to be supported on a floor or a ground surface. Sides extending upward from the bottom to an open top define a volume of space to hold refuse and garbage deposited therein. Because these trash containers typically have a relatively high center of gravity, a relatively small tipping force applied to a side of the trash container can cause the trash container to be tipped onto a side.

Tipping forces applied to a trash container can come from any number of sources. For example, an animal interested in eating garbage placed in a trash container can sometimes tip a trash container onto its side in order to gain access to the garbage contained therein. Household pets, such as dogs, are notorious for this sort of behavior. In another example, a curious toddler may tip the container onto its side. In yet another scenario, a pedestrian inadvertently bumping into the trash container can cause the container to tip onto its side. Sometimes, trash containers set in an outdoor environment can be tipped over due to wind forces. Once a trash container is tipped onto its side, some garbage contained therein may spill from the open top and onto the floor, creating an unwanted mess. Further, the open top can provide easy access for an animal or toddler to the remaining garbage inside container. Sometimes the trash container is placed near or against a wall to remove it from general traffic areas and to provide some additional stability to prevent tipping. However, placing a trash container near or against a wall is often not enough to prevent a hungry pet or curious toddler from tipping the container onto its side.

BRIEF SUMMARY OF THE INVENTION

The present invention provides for a coupling assembly for releasably connecting a trash container with a fixed object, such as a wall or cabinet. The coupling assembly acts to prevent the trash container from being easily tipped onto its side, while allowing a user to easily disconnect the trash container from the fixed object. The coupling apparatus includes a first coupling member connected with the fixed object and a second coupling member connected with the trash container. The second coupling member includes an extended portion adapted to be received within a pocket on the first coupling member. The coupling assembly can be configured to work with trash containers having different shapes and sizes. The trash container can also include a lid to further restrict access to the inside of the trash container. As described below, a latch or clasp can also be used to selectively lock the lid in a closed position.

In one aspect of the present invention a coupling assembly for releasably connecting a trash container to a fixed object includes a first coupling member adapted to connect with the fixed object. The connection between the first coupling member and the fixed object defines a pocket having an open top and a least one side. The coupling assembly further includes a second coupling member adapted to connect with the trash container. The second coupling member includes an extended portion adapted to be received within the pocket. When the extended portion of the second coupling member is received within the pocket, forces exerted on the trash can in a direction orthogonal to the at least one side are resisted.

The present invention also provides a method for releasably coupling a trash container to a fixed object. A first coupling member is connected with the fixed object, the first coupling member including a recess forming a pocket between the first coupling member and the wall. A second coupling member is connected with the trash container, the second coupling member having an extended portion adapted to be received within the pocket. The trash container is then moved to insert the extended portion of the second coupling member into the pocket.

The features, utilities, and advantages of various embodiments of the invention will be apparent from the following more particular description of embodiments of the invention as illustrated in the accompanying drawings and defined in the appended claims.

DETAILED DESCRIPTION OF THE INVENTION

Aspects of the present invention involve coupling assemblies for trash containers that allow a user to releasably connect a trash container with a fixed object, such as a supporting structure, to resist tipping. More particularly, the coupling assembly includes a first coupling member connected with a fixed object, such as the supporting structure, and a second coupling member connected with a side of the trash container. The first coupling member and second coupling member are adapted to be interconnected with each other to hold the trash container securely to the fixed object so as to resist tipping forces. The coupling assembly also allows a user to easily disconnect the trash container from the fixed object in order to empty the contents contained therein. Although the coupling assembly is described and depicted below as being used to releasably connect a trash container with a support structure in the form of a wall, it is to be appreciated that the coupling assembly can be used to releasably connect the trash container with other types of fixed objects or support structures, such as a cabinet. In other applications, the coupling assembly is used to releasably connect a trash container with a support structure in the form of a door. The coupling assembly can be used with various types of trash containers having different sizes and shapes. As discussed in more detail below, the trash container can also include a removable lid to restrict access to the inside of the trash container. To further restrict access to the inside of the trash container, a latch or clasp can be used to lock the lid in a closed position on the trash container.

Figure 1:
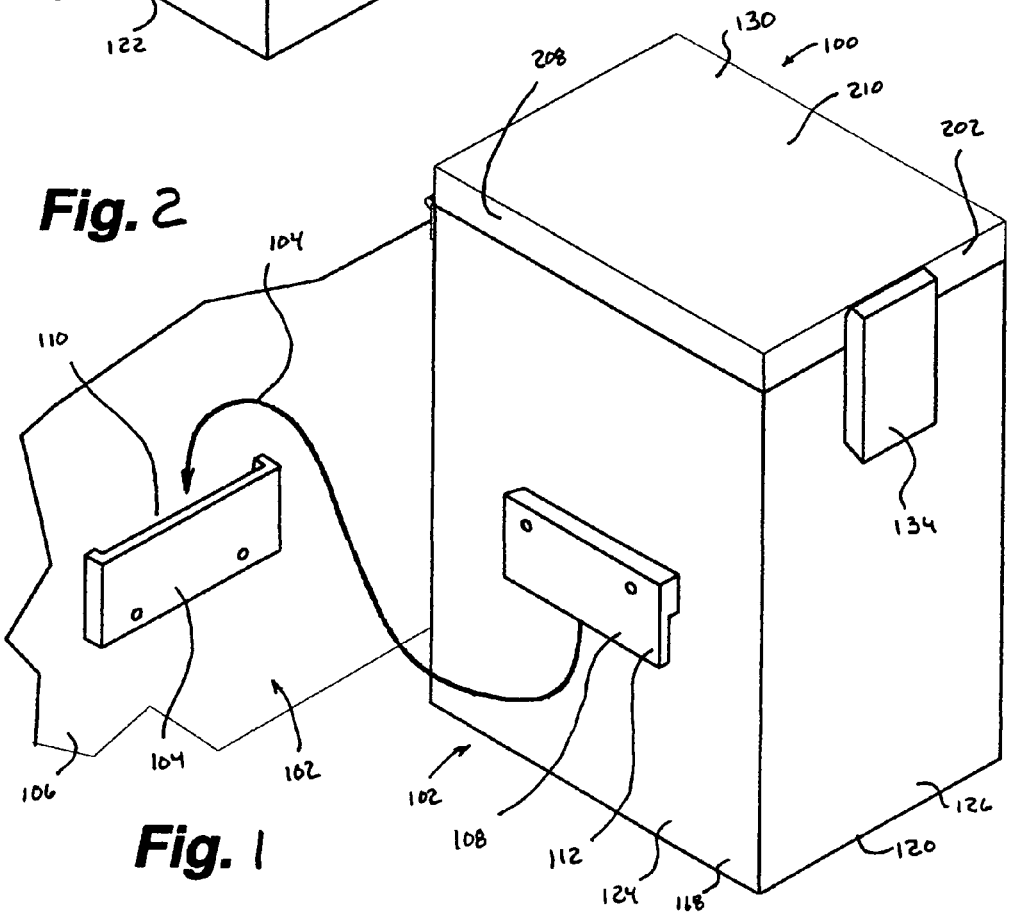
FIG. 1 is a left front isometric view of a trash container utilizing the present invention.

A trash container 100 and an embodiment of a coupling assembly 102 conforming to aspects of the present invention are shown in FIGS. 1-4. As shown in FIG. 1, the coupling assembly 102 includes a first coupling member 104 connected with a wall 106 and a second coupling member 108 connected with the trash container 102. As discussed in more detail below, the connection of the first coupling member 104 with the wall 106 defines an upwardly opening pocket 110 adapted to receive an extended portion 112 of the second coupling member 108. To connect the trash container 100 with the wall 106, the trash container is lifted and moved in a path generally defined by the directional arrow and associated path line 114 shown in FIG. 1. More particularly, a user connects the trash container 100 with the wall 106 by moving the trash container to place the extended portion 112 of the second coupling member 108 into the pocket 110 between the wall 106 and the first coupling member 104, as shown in FIG. 5. Once the trash container 100 is connected with the wall 106, the coupling assembly 102 resists tipping forces exerted on the trash container. To disconnect the trash container from the wall, the trash container is moved in a generally upward direction parallel to the wall until the extended portion of the second coupling member is removed from the pocket, as illustrated by the directional arrow 116 in FIG. 7.

As shown in FIGS. 1-4, the trash container 100 includes a body 118 defined by four sides extending upwardly from a closed bottom side 120 to an open top 121. More particularly, relatively wide right and left sides (122, 124) are connected with and are separated by relatively narrow front and rear sides (126, 128), defining a generally rectangular-shaped cross section. As discussed in more detail below, the trash container 100 can also include a lid 130 pivotally connected with the body 118 through a hinge 132. The lid 130 is adapted to engage the body 118 of the trash container 100 to selectively close the open top 121. The trash container 100 can also be provided with a latch 134 to selectively lock the lid 130 in a closed position on the body 118. Although the trash container is described and depicted herein as having a body with four relatively flat sides, it is to be appreciated that the present invention can be configured to work with trash containers having other shapes and sizes. For example, the coupling assembly can be configured to work with a trash container having a tubular-shaped body with an arcuate outer side defining a circular or oval cross section.

Figure 8B:
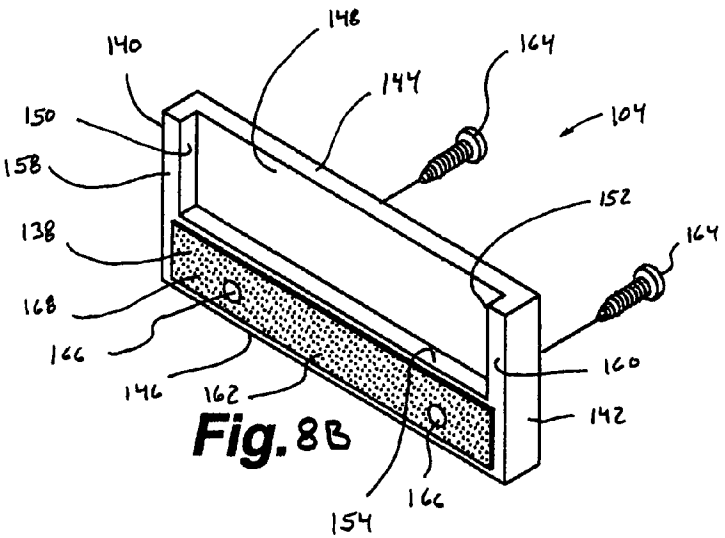
FIG. 8B is a rear isometric view of the first coupling member.
Figure 8A:
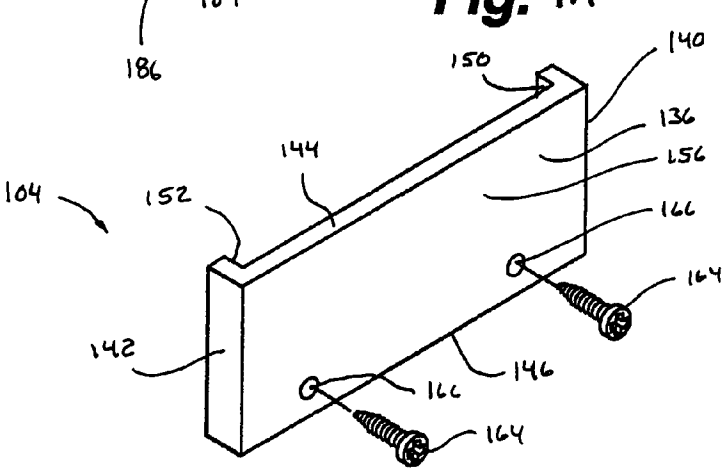
FIG. 8A is a front isometric view of a first coupling member.

As previously mentioned, the first and second coupling members (104,108) are adapted to engage each other so as to releasably connect the trash container 100 with the wall 106. In particular, the connection of the first coupling member 104 with the support structure or wall 106 defines the pocket 110 adapted to receive the extended portion 112 of the second coupling member 108. One embodiment of the first coupling 104 member is shown in FIGS. 8A-8B. The first coupling member 104 includes a first panel having rectangular-shaped front and rear sides (136, 138) separated by four relatively thin edge sides. More particularly, relatively short right and left edge sides (140,142) or side segments are connected with and are separated by relatively long top and bottom edge sides (144,146). A rectangular-shaped recess 148 in the rear side 138 of the first coupling member 104 defines a relatively thin upper segment of the first panel having right and left ledges (150,152) extending downward from the top edge side 144. The right and left side ledges are connected with and are separated by a bottom ledge 154. The front side 136 of the first coupling member 104 defines a generally flat outer surface 156, and the rectangular-shaped recess 148 in the rear side is surrounded by generally flat right and left upper rear surfaces (158,160) and a lower rear surface 162 defined on a relatively thick lower segment of the first panel. As shown in FIG. 1, when the first coupling member 104 is installed for use, the right and left upper rear surfaces (158, 160) and the lower rear surface 162 of the rear side 138 are placed in abutting relationship with the wall 106. An open space between the rectangular-shaped recess 148 and the wall 106 defines the pocket 110 adapted to receive the extended portion 112 of the second coupling member 108. It is to be appreciated that the first coupling member can be configured in different ways to form a pocket having a different shape than that which is described and depicted herein.

The first coupling member 104 can be connected with a fastening system to the wall 106 in several different ways. For example, as shown in FIGS. 8A-8B, two screws 164 received through two screw apertures 166 in the first coupling member 104 can be used to connect the first coupling member to the wall. An adhesive strip 168 placed on the rear side 138 of the first coupling member 104 along the lower rear surface 162 can also be used to connect the first coupling member 104 with the wall 106. In some applications, it is advantageous to use the adhesive strip 168 in combination with the screws 164 to connect the first coupling member 104 with the wall 106. Different quantities and/or types of screws can be used with present invention, and are not limited to use with that which is described and depicted herein. In addition, it is to be appreciated that various types and/or quantities of adhesive can be used to connect the first coupling member with the wall. For example, one embodiment of the present invention utilizes double-sided tape manufactured by Bron. In another scenario, Velcro™ is used to connect the first coupling member with the wall.

Figure 9B:
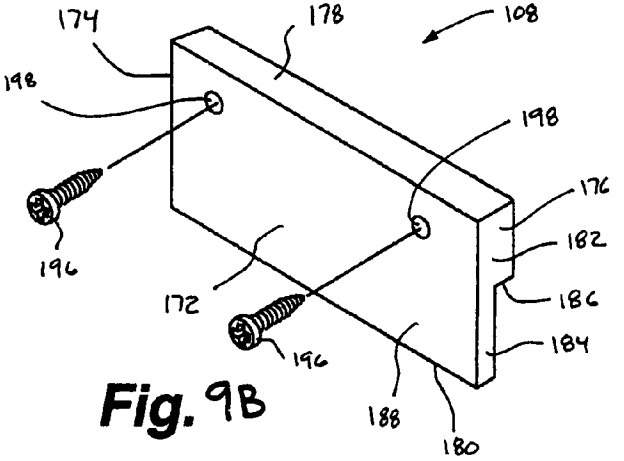
FIG. 9B is a rear isometric view of the second coupling member.
Figure 9A:
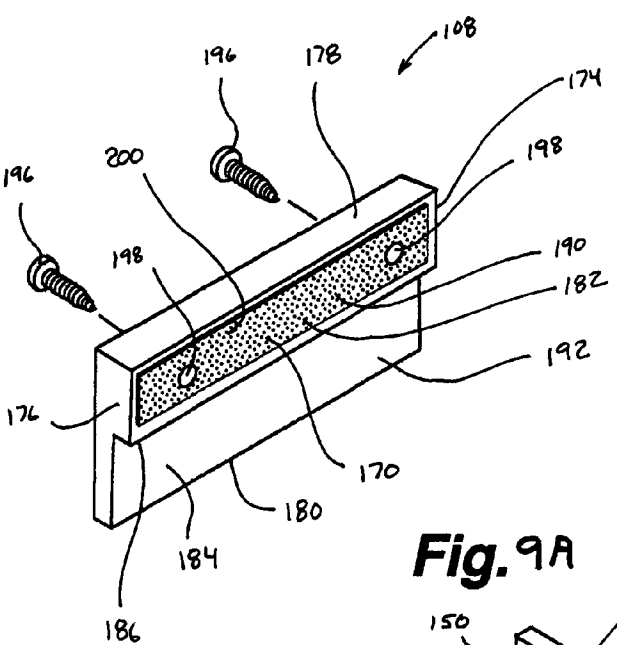
FIG. 9A is a front isometric view of a second coupling member.

As previously mentioned, the extended portion 112 of the second coupling member 108 is adapted to be received through a slotted access at the top of the pocket 110 between the wall 106 and the first coupling member 104. One embodiment of the second coupling member 108 is shown in FIGS. 9A-9B. The second coupling member 108 includes generally rectangular-shaped second panel with front and rear sides (170, 172) separated by four relatively thin edge sides. More particularly, relatively short right and left edge sides (174, 176) are connected with and are separated by relatively long top and bottom edge sides (178, 180). The second coupling member 108 also includes a relatively thick upper segment or portion 182 connected with a relatively thin lower segment or portion 184. The intersection of the relatively thick upper portion 182 and the relatively thin lower portion 184 defines an upper ledge 186 extending along the front side 170 between the right and left edge sides (174, 176), as shown in FIG. 9A. The relatively thin lower portion 184 extends downward from the upper ledge 186 and defines the extended portion 112 of the second coupling member 108 adapted to be received within the pocket 110 as mentioned above. The rear side 172 of the second coupling member 108 defines a generally flat outer surface 188 which is positioned adjacent to the wall 106 when the second coupling member 108 is connected with first coupling member 104. The front side 170 of the second coupling member 108 is defined by a generally flat upper front surface 190 and a generally flat lower front surface 192 separated by the upper ledge 186. As shown in FIG. 1, when the second coupling member is 108 connected with trash container 100 for use, the upper front surface 190 of the front side 170 is placed in abutting relationship with the trash container 100. The extended portion 112 of the second coupling member 108 is spaced apart from the trash container 100 by a distance defined by the width of the upper ledge 186. As such, a gap 194 is defined between the lower front surface 192 of the front side 170 of the second coupling member 108 and the trash container 100. It is to be appreciated that the upper front surface can be configured with different shapes to conform to differently shaped trash containers. For example, the upper front surface can be arcuately shaped to conform to a curved outer surface of a trash container with a round or oval-shaped cross section. Further, the extended portion of the second coupling member can be configured in different shapes and sizes and should not be limited to that which is described and depicted herein.

As described above with reference to the first coupling member 104, it is to be appreciated that the second coupling member 108 can be connected with the trash container 100 in several different ways. For example, as shown in FIGS. 9A-9B, two screws 196 received through two screw apertures 198 in the second coupling member 108 can be used to connect the second coupling member with the trash container 100. An adhesive strip 200 placed on the front side 170 of the first coupling member 104 along the upper front surface 190 can also be used to connect the second coupling member 108 with the trash container 100. In some applications, it might advantageous to use the adhesive strip in combination with the screws to connect the second coupling member with the trash container. Different quantities and/or types of screws can be used with present invention, and are not limited to use with that which is described and depicted herein. As described above with the reference to the first coupling member, various types and/or quantities of adhesive can be used to connect the second coupling member with the wall. In addition, Velcro® can be used to connect the second coupling member with the trash container.

It is to be appreciated that the first and second coupling members (104, 108) can be constructed from various types of materials. For example, in one application, the first and second coupling members are constructed from a PVC (poly vinyl chloride) material, such as Komatex®. In yet another application, the first and second coupling members are constructed from plastic through an injection molding process.

The coupling assembly 102 can be installed for use in various locations depending upon the particular application and/or the user's preference. The coupling assembly 102, described with reference to FIGS. 1-9B, may be installed according to the method depicted in FIG. 10. As illustrated, a user first selects the fixed object 106 to which the first coupling member 104 will be connected (step 1000). As previously mentioned, the first coupling member can be connected with various types of fixed objects, such as a wall or a cabinet. Next, user selects an installation height above the floor or ground 201 at which the first coupling member 104 will be located (step 1001). The installation height can vary depending upon the user's preference and the size of trash container 100. For example, in one application, the desired installation height is 14 inches from the floor to the bottom edge side 146 of the first coupling member 104. Once the installation height is selected, the user aligns the bottom edge side of the first coupling member parallel with the floor or ground 201 (step 1002). Alignment of the first coupling member 104 with the floor or ground 201 can be accomplished in a number of ways. For example, the user can make two marks on the fixed object at equal heights above the floor or ground. The user can align the bottom edge side of the first coupling member with the two marks. In another scenario, the user utilizes a level to align the first coupling member. Once the first coupling member is properly aligned, the first coupling member 104 is connected with the fixed object 106 (step 1003). As mentioned above, the first coupling member can be connected with the fixed object in a number of different ways. For example, the first coupling member 104 shown in FIGS. 8A-8B can be connected with the fixed object 106 with the adhesive strip 168 on the rear side 138, with the two mounting screws 164, or a combination of both screws and adhesive.

Figure 10:
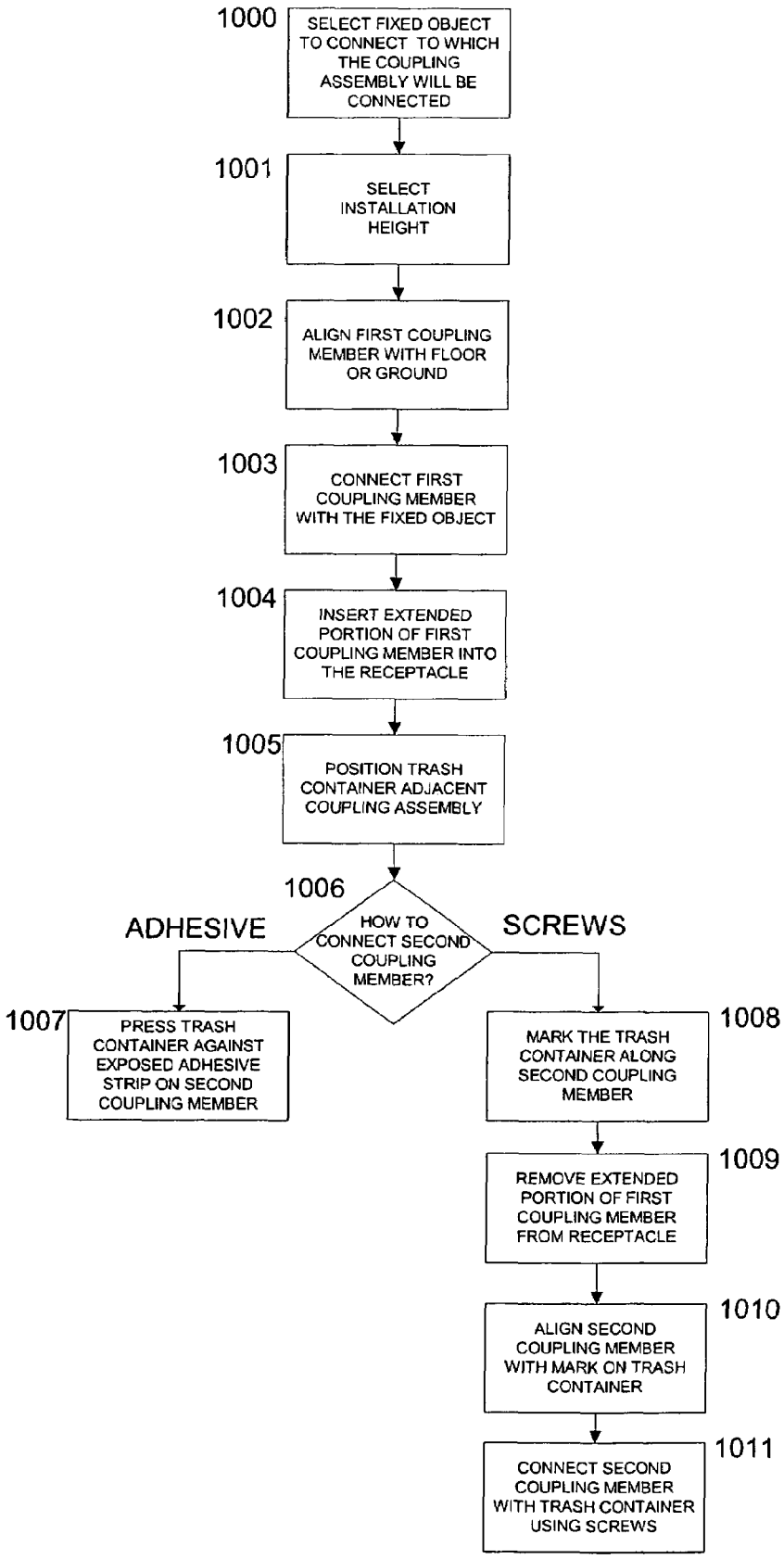
FIG. 10 is a flowchart illustrating a method for installing the releasable coupling.

Once the first coupling member 104 is connected with the fixed object 106, the extended portion 112 of the second coupling member inserted into the pocket 110 with the rear side 172 of the second coupling member 108 adjacent to the fixed object 106 (step 1004). As such, the upper ledge 186 on the second coupling member 108 is supported on the top edge side 144 of the first coupling member 104. Next, the trash container 100 is placed on the floor or ground 201 with one side of the body 118 adjacent to the coupling assembly 102 (step 1005). At this point, the user can choose how to connect the second coupling member 108 with the trash container 100 (step 1006). For example, if an adhesive strip 200 is used (shown in FIG. 9A), the trash container 100 can be pressed against the exposed adhesive strip 200 on the front side 170 of the second coupling member 108 (step 1007). If screws 196 are used to connect the second coupling member 108, the user can mark the side 124 of the trash container 100 adjacent the coupling assembly 102 along the second coupling member 108 (step 1008). Next, the extended portion 112 of the second coupling member 108 is removed from the pocket 110 (step 1009), and the second coupling member 108 is aligned with the mark on the trash container (step 1010) with the upper front surface 190 of the front side 170 abutting the trash container 100. Screws 196, such as those shown in FIGS. 9A-9B are then used to connect the second coupling member 108 with the trash container 100 (step 1011). It is to be appreciated that the order in which the operations shown in FIG. 10 are performed may vary, and should not be construed to be limited to the order depicted.

Once the first coupling member 104 is connected with the fixed object 106 and the second coupling member 108 is connected with the trash container 100, the trash container can easily be connected with and disconnected from the fixed object. For example, FIG. 1 shows the first coupling member 104 connected with the wall 106 and the second coupling member 108 connected with the left side 124 of the trash container 100. It is to be appreciated that the second coupling member can be connected with any side of the trash container and is not limited to being connected with only the left side.

As previously mentioned, the trash container 100 can be connected with the wall 106 by moving the trash container in the direction illustrated by the directional arrow and associated path line 114 to insert the extended portion 112 of the first coupling member into the pocket 110.

Figure 3:
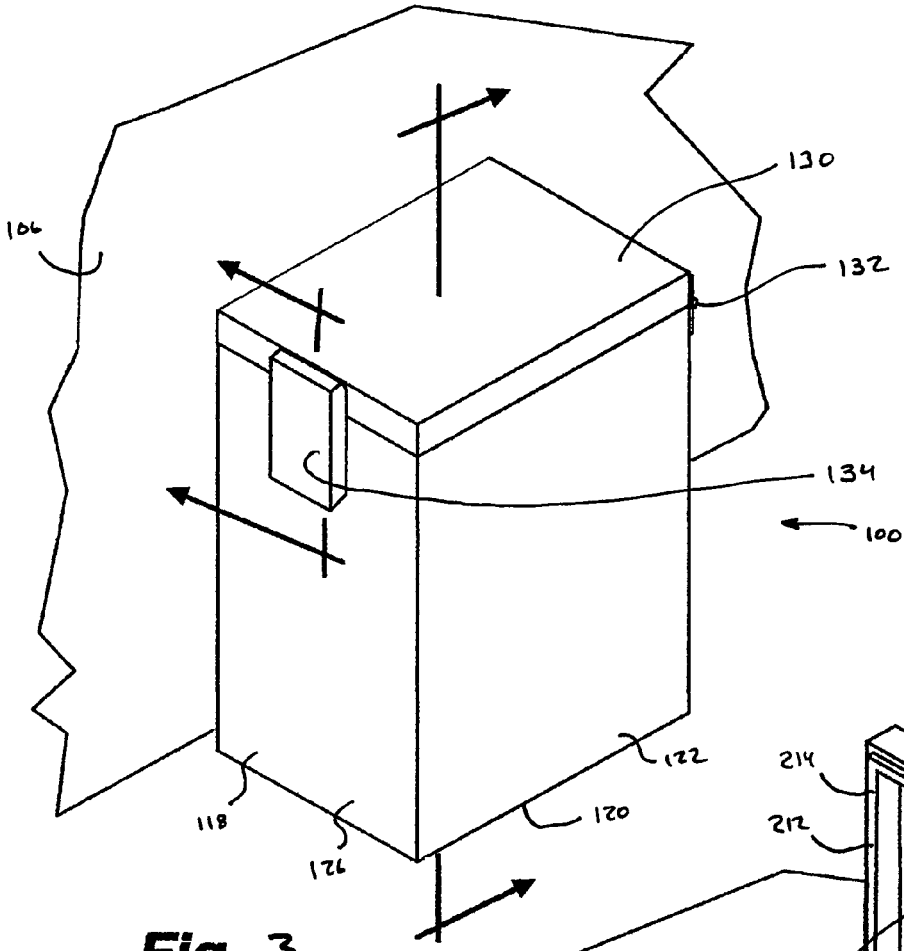
FIG. 3 is an isometric view of the trash container depicted in FIG. 1 connected with a wall.
Figure 4:
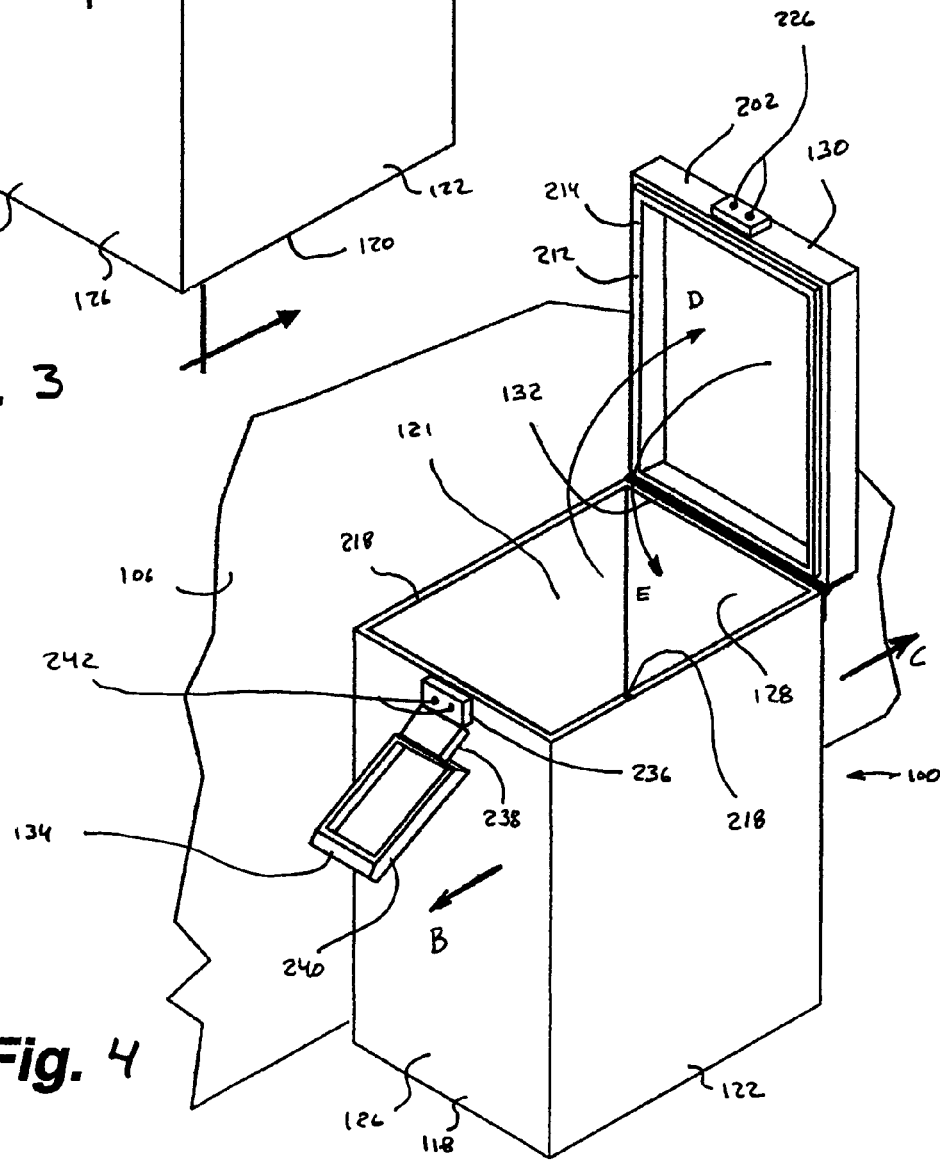
FIG. 4 is an isometric view of the trash container depicted in FIG. 3 with a lid in an open position.
Figure 5:
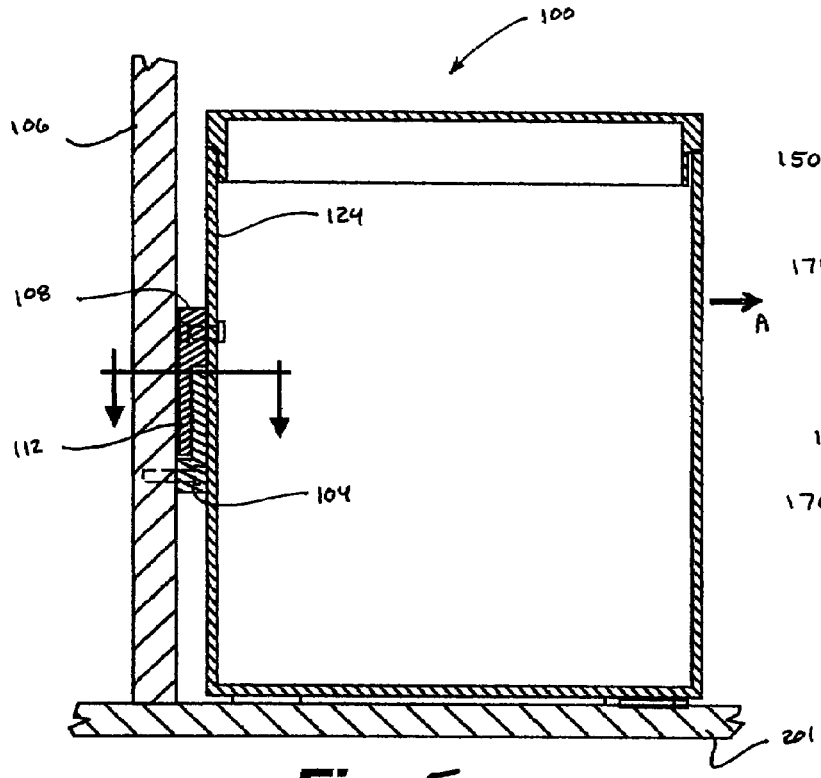
FIG. 5 is a cross-sectional view of the trash container depicted in FIG. 3, taken along line 5-5.
Figure 6:
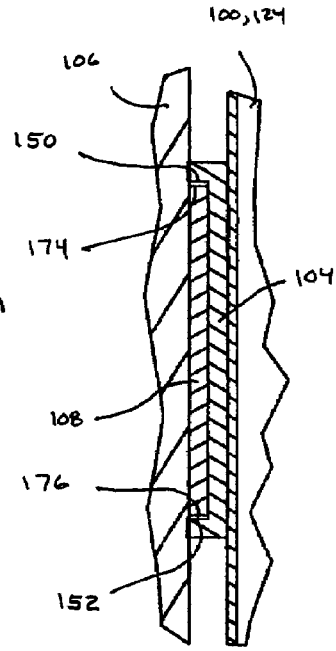
FIG. 6 is a cross-sectional view of a coupling depicted in FIG. 5, taken along line 6-6.

FIGS. 3-5 illustrate the trash container 100 connected with the wall 106 and FIG. 6 shows a cross-sectional view of the extended portion 112 inserted into the pocket 110. As shown in particular in FIGS. 5-6 and with reference to FIGS. 8A-9A, the rear side 172 of the second coupling member 108 is adjacent to the wall 106 and the front side 170 of the extended portion 112 is adjacent to the rectangular-shaped recess 148 on the rear side 138 of first coupling member 104. The front side 136 of the first coupling member 104 is adjacent to the left side 124 of the trash container 100. In addition, the right and left edge sides (174, 176) of the second coupling member 108 are in closed proximity adjacent to the right and left ledges (150, 152) on the first coupling member, respectively. Further, the bottom edge side 180 of the second coupling member 108 is in close proximity adjacent to the bottom ledge 154 of the first coupling member 104, and the upper ledge 186 of the second coupling member 108 is in close proximity adjacent to the top edge side 144 of the first coupling member 104. As such, the when the trash container 100 is connected with the wall 106, the weight of the trash container is supported by the floor 201, as opposed to the first coupling member 104. It is to be appreciated, however, that in some applications, the coupling assembly can be configured to support the trash container above the floor.

As previously mentioned, tipping forces from a number of different sources, such as a hungry dog or a curious toddler, can be exerted on the trash container. When the trash container 100 is connected with the wall 106, the engagement between the first and second coupling members (104, 108) acts to resist tipping forces exerted on the trash container. For example, a tipping force exerted on the trash container 100 in a direction away from the wall (represented by directional arrow "A" in FIG. 5) would be resisted the engagement between the lower front surface 192 of the extended portion 112 of the second coupling member 108 and the rectangular-shaped recess 148 on the rear side 138 of the first coupling member 104. In another scenario, tipping forces exerted on either the front or rear sides (126, 128) of the trash container 100 (represented by directional arrows "B" and "C", respectively, in FIG. 4) would be resisted by the engagement between the right and left edge sides (174, 176) of the second coupling member 108 and the right and left ledges (150, 152) of the first coupling member 104.

Figure 7:
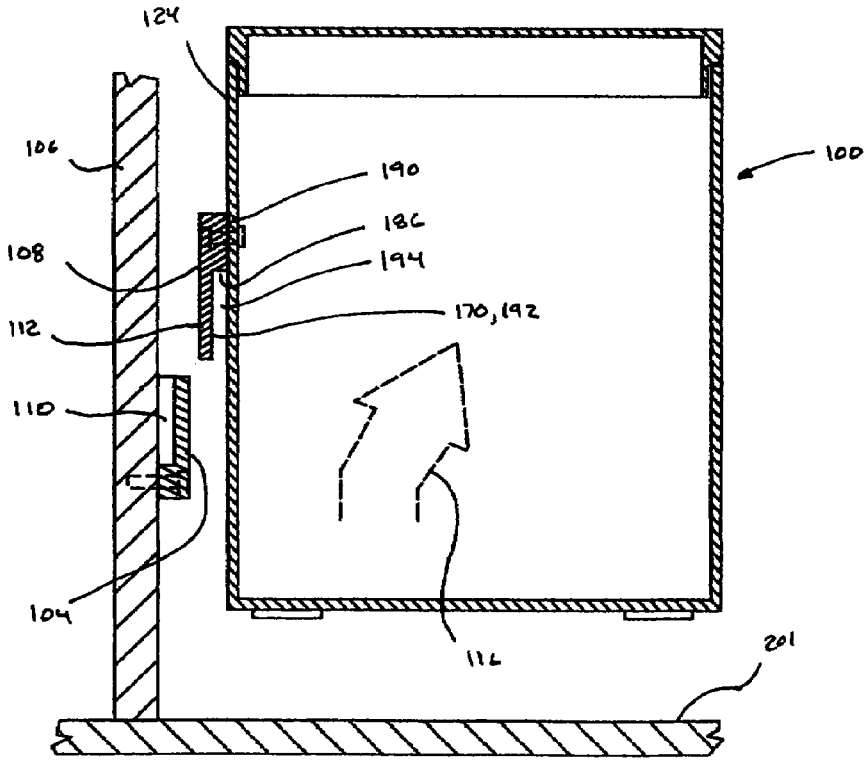
FIG. 7 is a view of the trash container depicted in FIG. 5 decoupled from the wall.

When the trash container 100 needs to be emptied or moved for various other reasons, a user can easily disconnect the trash container from the wall 106 by simply moving the container in the proper direction to decouple the first and second coupling members (104, 108). For example, as shown in FIG. 7, the trash container 100 is disconnected from the wall 106 by lifting the container in an upward direction generally parallel to the wall until the extended portion 112 of the second coupling member 108 is removed from the pocket. As such, the user does not need to unlatch or manipulate some sort of locking mechanism to disconnect the trash container from the wall. Instead, the user need only move the trash container in the proper direction to disengage the second coupling member 108 from the first coupling member 104. As such, the coupling assembly 102 provides a simple way to connect and disconnect the trash container 100 from the wall 106 while at the same time resisting movement of the trash container in directions that would otherwise cause the trash container to tip onto one of its sides.

Figure 2:
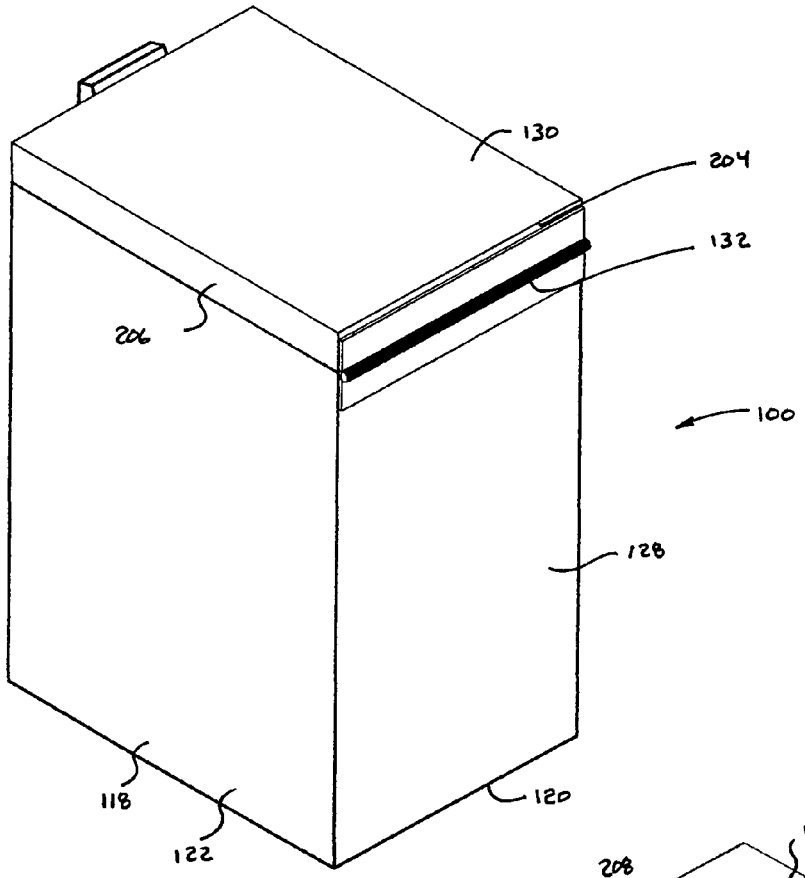
FIG. 2 is a right rear isometric view of the trash container depicted in FIG. 1.
Figure 12:
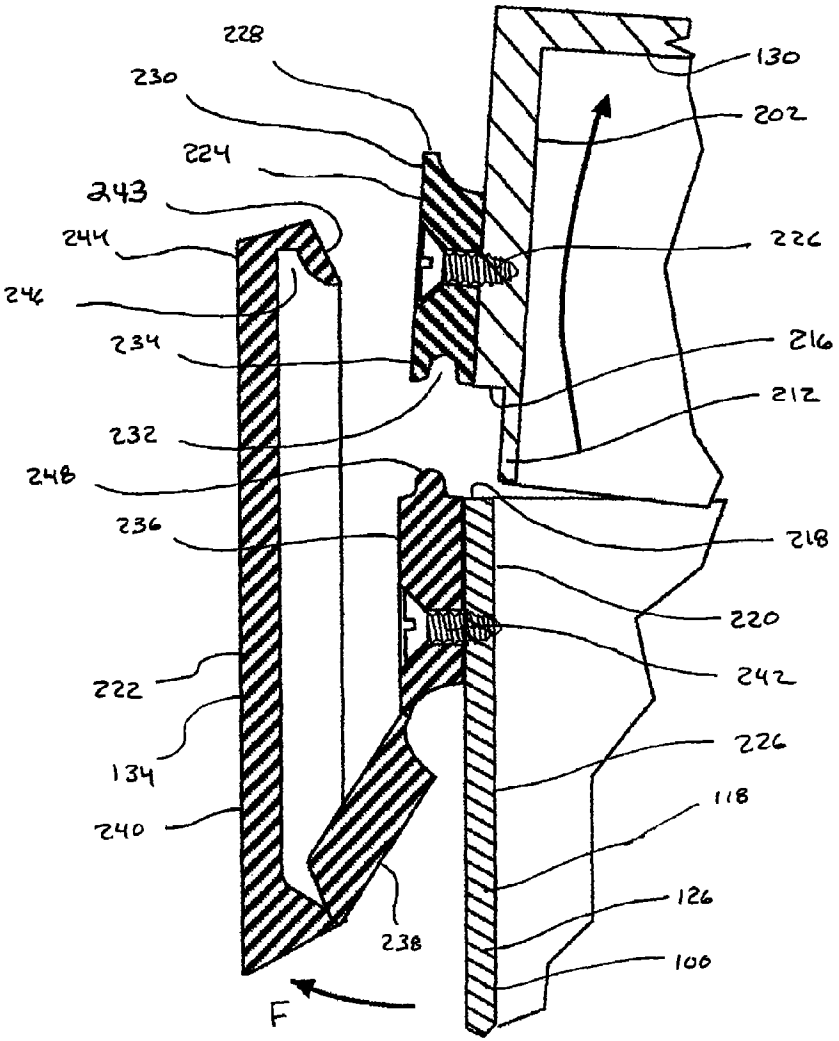
FIG. 12 is a view of the lid clasp configured to allow the lid to open.
Figure 11:
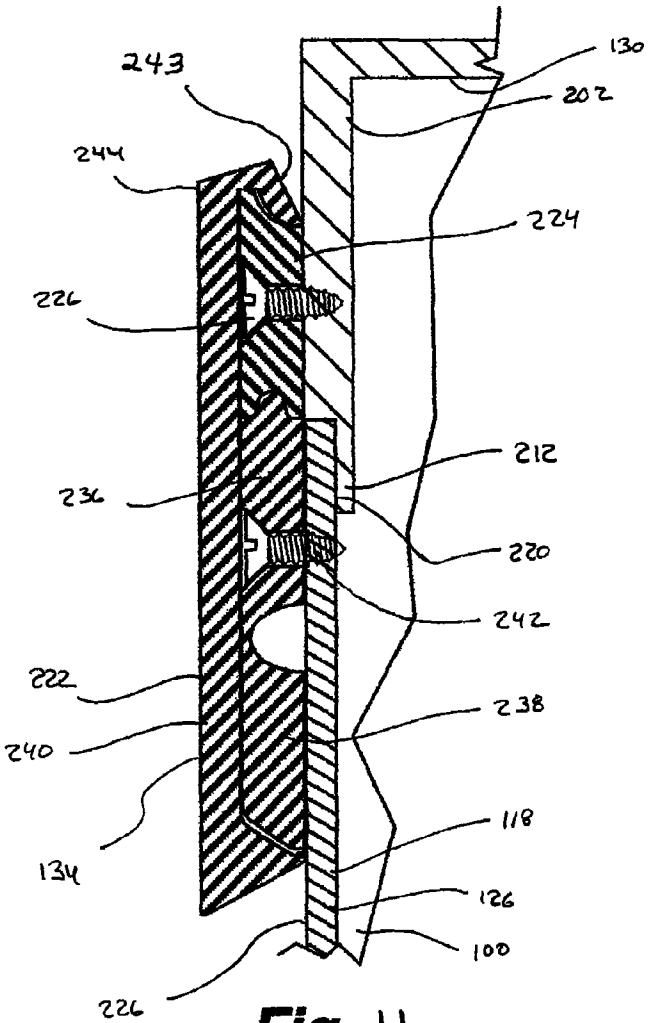
FIG. 11 is a cross-sectional view of a lid clasp depicted in FIG. 3, taken along line 10-10.

As previously mentioned, the trash container 100 can also include a lid 130 to further restrict access to the contents of the trash container. As shown in FIGS. 1-4, the lid 130 is defined by four sides (202, 204, 206, 208) extending downward from generally rectangular-shaped top side 210. The lengths of the four sides (202, 204, 206, 208) of the lid correspond with the widths of the four sides (126, 128, 122, 124) of the body of the trash container 100. As shown in FIGS. 4 and 11-12, a relatively thin seal wall 212 extends downward along a bottom perimeter 214 of the lid to define a ledge 216. When the lid 130 is in closed position as shown in FIGS. 3 and 4, the ledge 216 engages upper side edges of the trash container body 118. In addition, the seal wall 212 extends downward from the ledge 216 inside and adjacent to an upper end portion 220 of the body 118 of the trash container 100. The seal wall 212 can act to reduce the amount of odors emanating from the trash container, which might be offensive smelling or attract an animal, such as a dog. As shown in FIGS. 2 and 4, the hinge 132 pivotally connects the lid to the rear side of the trash container body. To open the trash container 100, the lid 130 is pivoted upward as indicated by directional arrow "D" in FIG. 4. To close the trash container, the lid 130 is pivoted downward as indicated by directional arrow "E" until the ledge 216 is seated on the upper side edges 218 of the trash container body 118. Although not shown, some trash containers are also equipped with a foot pedal to open the lid. As previously mentioned, although the trash container depicted herein includes a lid pivotally connected thereto, it is to be appreciated that the coupling assembly can be utilized to work with trash containers having removable lids as well as trash containers without lids.

As previously mentioned, the trash container can also include a latch or clasp to selectively lock the lid in the closed position. Various types of latches and clasps can be used with the lid and trash container. For example, the latch 134 shown in detail in FIGS. 3 4 and 11 12 is similar to the draw latch disclosed in U.S. Pat. No. 3,466,076, titled "Draw Pull Latch," filed on Sep. 15, 1967, which is hereby incorporated herein by reference. The latch 134 includes a latch member 222 adapted to selectively connect with a stud member 224. The latch member 222 is connected with an upper end portion 226 of the front side 126 of the trash container body 118, and the stud member 224 is connected with the lid 130. As shown in FIGS. 3 4 and 11 12, two screws 226 connect the stud member 224 with the lid 130. The stud member 224 includes a flange 228 formed in an upper end portion 230 and a groove 232 formed in a lower end portion 234. The latch member 222 includes a base segment 236 flexibly connected with an intermediate segment 238, which in turn, is flexibly connected with a locking segment 240. Two screws 242 connect the base segment 236 with front side 126 of the trash container body 118. An overhang 243 located on an upper end portion 244 of the locking segment defines a recess 246 adapted to receive the flange 228 on the stud member 224. A plug 248 extending upward from the base segment is adapted to be received within the slot in the stud member.

FIGS. 3 and 11 illustrate the latch 134 in a locked configuration and FIGS. 4 and 12 illustrate the latch 134 in an unlocked configuration. As shown in FIGS. 3 and 11, when the latch is in the locked configuration, the flange 228 on the stud member 224 is received within the recess 246 on the locking segment 240, and the plug 240 on the base segment 236 is received within the groove 232 on the stud member 224. The interaction between the base, intermediate, and locking segments in combination with the stud member holds the latch in the locked position. The latch is unlocked by applying force (illustrated by directional arrow "F" in FIG.

12) to the locking segment 240, which disengages the latch member 222 from the stud member 224. As previously mentioned, although the trash container 100 depicted herein includes the latch 134 to selectively lock the lid 130 into a closed position, it is to be appreciated that the trash container need not include a latch.

It will be appreciated from the above noted description of the present invention that a coupling assembly for releasably connecting a trash container to a fixed object has been described, which includes a first coupling member and a second coupling member. The coupling members can be formed in various ways and operated in various manners depending upon the shape of the fixed object and trash container. It will be appreciated that the features described in connection with the invention are interchangeable to some degree so that many variations beyond those specifically described are possible. For example, the first coupling member can be connected with the trash container and the second coupling member can be connected with the wall in a orientation that is upside down from which has been described above. It is also contemplated that the first coupling member can include a pocket therein as opposed to forming the pocket between the wall and the rectangular-shaped recess.

Although various representative embodiments of this invention have been described above with a certain degree of particularity, those skilled in the art could make numerous alterations to the disclosed embodiments without departing from the spirit or scope of the inventive subject matter set forth in the specification and claims. All directional references (e.g., upper, lower, upward, downward, left, right, leftward, rightward, top, bottom, above, below, vertical, horizontal, clockwise, and counterclockwise) are only used for identification purposes to aid the reader's understanding of the embodiments of the present invention, and do not create limitations, particularly as to the position, orientation, or use of the invention unless specifically set forth in the claims. Joinder references (e.g., attached, coupled, connected, and the like) are to be construed broadly and may include intermediate members between a connection of elements and relative movement between elements. As such, joinder references do not necessarily infer that two elements are directly connected and in fixed relation to each other.

In some instances, components are described with reference to "ends" having a particular characteristic and/or being connected with another part. However, those skilled in the art will recognize that the present invention is not limited to components which terminate immediately beyond their points of connection with other parts. Thus, the term "end" should be interpreted broadly, in a manner that includes areas adjacent, rearward, forward of, or otherwise near the terminus of a particular element, link, component, part, member or the like. In methodologies directly or indirectly set forth herein, various steps and operations are described in one possible order of operation, but those skilled in the art will recognize that steps and operations may be rearranged, replaced, or eliminated without necessarily departing from the spirit and scope of the present invention. It is intended that all matter contained in the above description or shown in the accompanying drawings shall be interpreted as illustrative only and not limiting. Changes in detail or structure may be made without departing from the spirit of the invention as defined in the appended claims.

What is claimed is:

1. A trash container in combination with a supporting structure, wherein said trash container has at least one side wall, and wherein said combination further includes, a first coupling member adapted to be releasably secured to said supporting structure, said first coupling member including a first panel with a relatively thick lower segment and a relatively thin upper segment and side segments extending along said upper segment to define an open recess of generally rectangular configuration between said upper segment and said side segments, and a fastening system in said lower segment for securing said first coupling member to said supporting structure, said fastening system including holes through said lower segment and fasteners for extending through said holes into said supporting structure, whereby said open recess is closed by being in confronting relationship with said supporting structure to define an upwardly opening pocket and a slotted access to said pocket is defined along a top of said first coupling member, and a second coupling member defined by a second panel of generally rectangular configuration having a relatively thick upper segment and a relatively thin lower segment, said lower segment conforming in size and configuration to said closed pocket, and a second fastening system in said upper segment of said second coupling member for releasably attaching said second coupling member to said side wall of said trash container, said second fastening system including holes through said upper segment of said second coupling member and fasteners for extending through said holes into said side wall of said trash container, whereby said lower segment of said second coupling member can be releasably positioned in said pocket in confronting relationship with said upper segment and said side segments of said first coupling member as well as said supporting structure to resist tipping forces on said trash container and to permit said trash container to be separated from said first coupling member only with an upwardly lifting motion on said trash container.

* * * * *